US005332652A

United States Patent [19]

Suzuki et al.

[11] Patent Number: 5,332,652

[45] Date of Patent: Jul. 26, 1994

[54] METHOD FOR MAKING LITHOGRAPHIC PRINTING PLATE

[75] Inventors: Shigeyoshi Suzuki; Akira Furukawa, both of Nagaokakyo, Japan

[73] Assignee: Mitsubishi Paper Mills, Ltd., Tokyo, Japan

[21] Appl. No.: 750,737

[22] Filed: Aug. 21, 1991

Related U.S. Application Data

[63] Continuation of Ser. No. 496,157, Mar. 19, 1990, abandoned, which is a continuation of Ser. No. 140,559, Jan. 4, 1988, abandoned.

[30] Foreign Application Priority Data

Mar. 9, 1987 [JP] Japan ..... 62-54450
Apr. 14, 1987 [JP] Japan ..... 62-92436

[51] Int. Cl.[5] ..... G04F 7/00

[52] U.S. Cl. ..... 430/302; 430/48; 430/49; 430/54; 101/463.1

[58] Field of Search ..... 430/49, 35, 54, 302; 101/453, 454, 463.1, 489; 156/625, 654

[56] References Cited

U.S. PATENT DOCUMENTS 4,053,863 10/1977 Marlor ..... 430/87
4,282,297 8/1981 Futland ..... 430/48
4,500,617 2/1985 Nakayama ..... 430/49
4,518,668 5/1985 Nakayama ..... 430/49
4,520,088 5/1985 Senga et al. ..... 430/49
4,673,627 6/1987 Kunichika et al. ..... 430/49

FOREIGN PATENT DOCUMENTS 1219849 1/1971 United Kingdom .

OTHER PUBLICATIONS

Research Disclosure, No. 154 Feb. 1977 pp. 16–17 R. F. Reithel "Lithography Plates of Electrically Activated Polymers".

"Charge Transfer Electrophotography" by R. L. Jepen and G. F. Day; Electrophotography 2nd International Conference p. 28.

*Primary Examiner*—Donald J. Loney
*Attorney, Agent, or Firm*—Cushman, Darby & Cushman

[57] ABSTRACT

This invention provides a method for making a lithographic printing plate of high resolving power and high printing endurance which comprises imagewise exposing a photoreceptor having a conductive layer and a printing sheet comprising a conductive support having thereon a dielectric non-photosensitive layer which are placed opposite to each other while applying a direct voltage between said conductive layer and said conductive support by a direct current source to form a positive electrostatic latent image on said non-photosensitive layer of the printing sheet and then subjecting the image to development and fixation.

9 Claims, No Drawings

METHOD FOR MAKING LITHOGRAPHIC PRINTING PLATE

This is a continuation of application No. 07/496,157, filed on Mar. 19, 1990, which was abandoned upon the filing hereof, which is a continuation of application No. 07/140,559, filed Jan. 4, 1988, now abandoned.

BACKGROUND OF THE INVENTION

This invention relates to a method for making a printing plate and a method of printing.

Hitherto, numerous printing plates have been developed and practically used.

As light sensitive lithographic printing plates which per se have light sensitivity, there have been known presensitized (PS) plates using diazonium compounds and the like, silver salt type printing plates utilizing silver halide and electrophotographic printing plates using zinc oxide or organic photo-conductive compounds.

As printing plates of high sensitivity and high printing endurance, those comprising an aluminum plate on which an organic photoconductive compound is coated are disclosed, for example, in Japanese Patent Examined Publication Nos. 17162/62, 6961/63, 2426/66 and 39405/71 and Japanese Patent Unexamined Publication Nos. 19509/75, 19510/75, 145538/79, 89801/79, 134632/79, 19803/79, 105254/80, 161863/82, 76843/83, 76844/83, 18658/83 and 244959/85. These printing plates are made through the steps of corona charging, camera exposure or laser exposure, wet or dry-type development, fixation and etching of non-image area with alkaline solution.

However, these plate making methods which use the above mentioned electrophotographic process suffer from some disadvantages and problems, though they have many other advantages. One of them results from use of the corona charging. That is, the mechanism of charging by corona discharge has not yet been clarified and this charging method has the unstableness that the corona charging is greatly affected by changes in temperature and humidity and photographic characteristics and printing characteristics are very dependent on such environmental conditions. Furthermore, when printing plates of large size such as those for newspaper are subjected to scanner exposure by argon, helium-neon or semiconductor lasers, use of corona charging results in difference in charge quantity between the front part and rear part of the printing plate owing to dark decay and thus it is difficult to form uniform toner images overall surface of the plate. Another disadvantage of the conventional method is due to enhancement of sensitivity.

That is, not only in so-called function-separated type printing plate comprising laminated charge generation layer and charge transport layer such as those disclosed in Japanese Patent Unexamined Publication Nos. 118658/83 and 244959/85 which are intended to increase sensitivity, but also in those of single layer type, film thickness of the coated layer is inevitably increased to sustain a sufficient surface charge and furthermore, since organic photoconductive compound is used in a large amount, etching ability of alkaline solution is reduced and as a result, resolving power is lowered or resists superior in printing endurance are difficult to produce.

Moreover, economical disadvantages of the conventional methods are that they are high in cost because expensive photoconductors are coated on printing plates themselves and virtually unable to recover and besides printing plates once used are practically difficult to reuse.

As a result of the inventors' intensive researches considering the various disadvantages and defects seen in the conventional electrophotographic lithographic printing plates, a method for making lithographic printing plates free from these problems has been found.

SUMMARY OF THE INVENTION

It is an object of this invention to provide a method for making lithographic printing plates of high resolving power and high printing endurance which is free from unstableness as in the conventional plate making methods using corona charging.

It is another object of this invention to provide a method for making a lithographic printing plate free from ununiformity in images as seen in the plate made by the conventional methods using corona charging and laser exposure.

It is still another object to provide a method for making an economically advantageous lithographic printing plate which may be reused, if necessary, at lower cost than in the conventional methods.

Other objects and advantages of this invention will be apparent from the following disclosures.

DESCRIPTION OF THE INVENTION

The gist of this invention resides in a method for making a lithographic printing plate, characterized by forming a positive electrostatic latent image on a dielectric non-photosensitive layer provided on a conductive support of printing sheet for lithographic printing plate by the process mentioned hereinafter and then subjecting the latent image to at least development and fixation.

Since an electrostatic latent image is formed on said non-photosensitive layer without corona charging and is developed and fixed according to this invention, the characteristics of the plate are stable to the changes of circumstances where the plate is made and further, uniform printed images can be obtained even if a printing plate of large size such as the whole kiku size (636 nun×939 mm) is made by laser scanner exposure method. Moreover, since the printing sheet has no photoconductor as the photosensitive material, said non-photosensitive layer, namely, printing layer can be made as thin as possible and thus resist property of the printing plate of which non-image area is removed by etching with alkaline solution can be improved and printing plates of high printing endurance can be obtained. Furthermore, according to this invention, photoreceptor which is separated from printing sheet is used and not only this photoreceptor can be repeatedly used, but printing sheet can also be reused by removing toner or printing layer of once used printing plate (in the latter case, only by coating a dielectric non-photosensitive layer on the support of the printing plate once used). Thus, economical advantage is great.

According to this invention, a printing sheet comprising a conductive support having thereon a dielectric non-photosensitive layer and a photoreceptor having a conductive layer are placed opposite to each other and this assembly is subjected to imagewise exposure from a light transmitting side, generally, light transmitting photoreceptor side while applying a direct voltage between the conductive support of the printing sheet and the conductive layer of the photo-receptor from a direct current source, to thereby form a positive electrostatic latent image on said non-photosensitive layer, which is then developed with a developer having polarity opposite to that of the latent image and is fixed.

The mechanism of formation of this positive electrostatic latent image is not necessarily clear, but some mechanism can be thought of. That is, one is that in the area irradiated with light, internal discharge occurs at the air-gap between the printing sheet and the photoreceptor where the voltage is above the break-down voltage due to the decrease in resistivity of photoreceptor, whereby charge is accumulated on said non-photosensitive layer resulting in formation of electrostatic latent image. Another one is that movable carrier formed in the area irradiated with light is injected and transferred into the dielectric surface by the action of external electrical field or charge is injected into said area from electrode surface and transfers to the dielectric surface, whereby an electrostatic image is formed thereon.

This invention is not limited to the mechanism of image formation and forms a positive electrostatic image on the exposed area by laser exposure or exposure to a negative original through the above mentioned processes.

The image formation method without corona charging as mentioned above is per se known, for example, in "Charge transfer electrophotography" (R.L. Jepsen and G.F. Day, "Electrophotography-2nd International Conference", D.R. White ed.. p28 (SPSE. 1974); M. Feinleib and S. Rutherford, Appln. Photogr. Eng., 4, 9 (1976)), etc.

However, these literatures make no mention of utilizing the methods for making lithographic printing plates and furthermore, makes no indication of high printing endurance of the printing plates, high reproductivity and stability in plate making, formation of uniform and high quality images by laser scanner plate making, economical advantages such as reduction of cost for printing plate and repetitive use of printing sheet.

Examples of the conductive supports used in the printing plate of this invention are preferably metal sheets such as aluminum sheet, zinc sheet, iron sheet, copper sheet, etc. Further, metal-deposited films, metal foil-laminated films or films subjected to conductive treatment may also be used.

In case of metal sheets, preferred are those which are subjected to surface treatments such as sandblasting, anodizing, etc. and such support has a function as an electrode at exposure and simultaneously can have hydrophilicity when printing plate is made by removal of non-image area by etching. In this case, the non-photosensitive layer coated on the support comprises a resin which can trap the charge transferred from photorecepter as dielectric or insulator and can be etched with alkaline solutions. As such resins, mention may be made of, for example, those which contain, as at least one component of copolymer, a monomer containing acidic group such as acrylic acid, methacrylic acid, crotonic acid or the like, for example, styrene-maleic anhydride copolymer, maleic ester resin, vinyl acetate-crotonic acid copolymer, vinyl acetate-maleic anhydride copolymer, (meth)acrylic ester-(meth)-acrylic acid copolymer, acrylic acid half ester, etc. and furthermore, phenolic resin, etc.

Since layer of these resins can be made as thin as 5 μm or less, sometimes as thin as 2 μm or less, even a tough film required for printing plate can be easily etched.

Another example of the printing plate of this invention is anodized aluminum sheet and in this case aluminum oxide layer constitutes the dielectric non-photosensitive layer, which also serves as hydrophilic surface. That is, according to this invention, when the dielectric non-photosensitive layer on the conductive support per se has a sufficient hydrophilicity or can be converted to hydrophilic layer, printing plate can be made without removing the non-image area by etching. An example of capable of rendering the non-image area hydrophilic after development and fixation is to use a non-photosensitive layer comprising an insulating resin having dispersed therein zinc oxide which undergoes substantially no exposure due to difference in sensitivity or sensitive wavelength when photoreceptor is exposed and to hydrophilize this layer, for example, with a hydrophilizing solution containing, for example, potassium ferrocyanide.

It is, of course, possible to use a printing sheet comprising a conductive support on which a compound or a web such as film which is per se hydrophilic and insulating is coated or laminated.

As photoreceptors in this invention, there may be used those which are generally used for electrophotographic system, but since non-light transmitting printing sheets are often used, light transmitting support such as film or glass is used as support for photoreceptor and besides this support for photoreceptor must have conductivity for forming electrode with the printing sheet. Photoconductive compound sensitive to laser beam as mentioned before is preferred as the photoreceptor component. There may be used organic photoconductors such as azo pigments, copperphthalocyanine, PVK-TNF, etc. or inorganic photoconductors such as non-crystalline selenium, cadmium sulfide, etc. These may be of function-separated type.

According to the method of this invention, a printing sheet and a photoreceptor placed opposite to each other are subjected to imagewise exposure while applying a suitable voltage (generally 400 V or higher) between the printing sheet and the photoreceptor. The printing sheet and the photoreceptor may be brought into close contact with each other or they may be positioned with providing a suitable air space therebetween (generally, about 1–20 μm) when voltage of latent image is to be increased.

The air space can be provided by forming uniform irregularity on the surface of the printing sheet or the photoreceptor. Specifically, the air space can be provided by allowing fine particles of suitable particle size to be present exposed on the surface of the printing sheet or the photoreceptor and bringing them in contact with each other.

When the surface of non-photosensitive layer, namely, the printing sheet is roughened by fine particles, resist property or etching speed at etching of non-image area with alkaline solution and a printing plate of high resolving power and high alkaline endurance can be obtained.

Further, non-photosensitive layer having surface roughened by fine particles forms uniform space with the photoreceptor placed opposite to the roughened surface of the non-image layer at the time of exposure, whereby applied voltage can be made uniform and reproducibility can be enhanced.

The fine particles used for the above purpose are of organic or inorganic compound and of about 1-about 20

μm, preferably about 3-about 15 μm in average particle size.

These fine particles are dispersed in the dielectric and alkali-soluble non-photosensitive layer and must not be those which are dissolved or molten during preparation of coating liquid for the non-photosensitive layer and formation of coating film to become miscible with the alkali-soluble resin.

As the fine particles, mention may be made of, for example, organic fine particles such as of polystyrene; crosslinked copolymers of styrene and divinylbenzene, etc; copolymers of styrene and unsaturated carboxylic acids such as acrylic acid; copolymers of styrene and (meth)acrylic acid lower alkyl esters or styrene, (meth-)acrylic acid lower alkyl esters and unsaturated carboxylic acid such as acrylic acid; polymethyl methacrylate; copolymers of methyl methacrylate and (meth)acrylic acid lower alkyl esters or methyl methacrylate, (meth)acrylic acid lower alkyl ester and unsaturated carboxylic acid such as acrylic acid, etc., inorganic fine particles such as of silicon dioxide, titanium dioxide, zinc oxide, calcium carbonate, etc., composite fine particles of organic and inorganic materials, crosslinked organic fine particles, etc.

Preferably, one or more kinds of these fine particles are contained in non-photosensitive layer in an amount of about 0.1-about 5% by weight, but they may be used in an amount outside said range. Height of irregularity on the roughened surface is preferably about 0.5-about 10 μm, but it may be outside this range.

Toner used for image formation may be either dry or wet toner, but wet toner for liquid developing is far preferable to dry toner for obtaining printing plate of superior resolving power. Further, toner is required to be hydrophobic and ink receptive and have enough adhesiveness to stand printing. The toner is further required to have resist property when etching with alkali and/or alcohol solution is carried out.

As alkalis used for etching solution, mention may be made of, for example, sodium hydroxide, potassium hydroxide, sodium carbonate, sodium silicate, sodium phosphate, potassium phosphate, ammonia, etc.

As alcohols, mention may be made of, for example, lower alcohols or aromatic alcohols such as menthanol, ethanol, propanol, benzyl alcohol, etc., ethylene glycol, diethylene glycol, triethylene glycol, polyethylene glycol, cellosolve, etc. The etching treatment can also be effected with aqueous alkali solution alone or alcohol alone.

The following is one example of etching solution which can be used in this invention.

| | |
|---|---|
| Monoethanolamine | 40 ml |
| Diethanolamine | 10 ml |
| Ethanol | 250 ml |
| Polyethylene glycol (molecular weight 600) | 400 ml |
| Water | 300 ml |

This invention is illustrated by the following examples.

EXAMPLE 1

A dispersion of copper-phthalocyanine in an acrylic resin was coated on a transparent conductive film (IP-001 of Mitsubishi Chemical Industries, Ltd.) and dried to obtain a photoreceptor.

Separately, phenolic resin was coated on a flexible aluminum sheet subjected to sandblasting treatment and anodizing treatment at 2 g/m$^2$ and dried to obtain a printing sheet.

Said photoreceptor and printing sheet (both in B5 size) were put together so that the coated sides contacted with each other and imagewise exposure was effected from backside of the photoreceptor through a transparent negative original while applying externally a voltage of 400 V between the photoreceptor and printing sheet from a direct current source.

After elimination of voltage, this printing sheet was subjected to development with liquid toner and fixation to obtain a positive image having a maximum image density of 1.5 and free from fog. Further, this printing sheet was subjected to etching with the above etching solution resulting in removal of non-image area in 15 seconds to obtain a printing plate having a resist image of good resolving power. A lot of prints could be made on a printing machine by this printing plate.

Then, after all of the resin layer of this once used printing sheet was removed by toner dissolving solution and said etching solution, said phenolic resin solution was coated in the same manner as above to obtain a printing sheet.

This example was repeated using this printing sheet and the same photoreceptor used above to obtain a printing plate of similarly high printing endurance.

EXAMPLE 2

A printing plate was made by exposure, development and fixation in the same manner as in Example 1 except that fine particles were dispersed in the photoreceptor and a flexible aluminum sheet subjected to sandblasting treatment and anodizing treatment per se was used as the printing sheet. This printing plate had maximum image density of 0.7 and was free from fog.

This printing plate can be used again as a printing sheet by removing only the toner image with a solvent after used for printing.

EXAMPLE 3

A dispersion of copper-phthalocyanine in acrylic resin was coated on a transparent conductive film (IP-001 of Mitsubishi Chemical Industries, Ltd.) and dried to make a photoreceptor.

Separately, on a flexible aluminum sheet subjected to sandblasting treatment and anodizing treatment were coated phenolic resin at 2 g/m$^2$ and monodispersing polystyrene fine particles of 4 μm in average particle size at 0.04 g/m$^2$ and the coat was dried to obtain a printing sheet. The photoreceptor and printing sheet (both in A3 size) were put together so that the coated sides thereof contacted with each other and subjected to exposure, development and fixation in the same manner as in Example 1 to obtain a good positive image of high density and free of fog without causing unsatisfactory contact in spite of the large size. Then, thus image formed printing sheet was subjected to etching with said etching solution to remove non-image area in 9 seconds. The resulting printing plate had a high printing endurance of such a degree that printing of 10,000 printed copies can be performed.

EXAMPLE 4

Example 3 was repeated except that 5 g/m$^2$ of styrene-butyl methacrylate-acrylic acid (60:20:20 by weight) copolymer was used in place of phenolic resin and 0.1 g/m$^2$ of polymethyl acrylate of 10 μm in average particle size was used in place of polystyrene fine particles. Photoreceptor used in Example 3 was reused here.

Similar results were obtained.

What is claimed is:

1. A method for making a lithographic printing plate which comprises placing, opposite to each other, (i) a printing sheet comprising a conductive support selected from the group consisting of a metal sheet, a metal-deposited film and a metal foil-laminated film, having thereon a dielectric non-photosensitive layer, and a photoreceptor comprising a film support having a conductive layer on which an organic photoconductive compound is provided, imagewise exposing the photoreceptor from a light transmitting side while applying a direct voltage between said conductive support and said conductive layer by a direct current source to form a positive electrostatic latent image on said non-photosensitive layer of the printing sheet and then subjecting the image to wet developing and fixation.

2. A method according to claim 1, wherein the dielectric non-photosensitive layer is a hydrophilic layer or a layer capable of being converted to a hydrophilic layer in its surface.

3. A method according to claim 2, wherein the surface of the printing sheet or the photoreceptor is roughened and an air space of about 1–20 μm is provided between the printing sheet and the photoreceptor which are placed opposite to each other.

4. A method according to claim 3, wherein the dielectric non-photosensitive layer of the printing sheet contains about 0.1 to about 5% by weight of fine particles having an average particle size of about 1 to about 20 μm.

5. A method according to claim 4, wherein the dielectric non-photosensitive layer of the printing sheet has a thickness of 5 μm or less.

6. A method according to claim 1, wherein the film support of the photoreceptor is a light transmitting film; the support of the printing sheet is a support subjected to sandblasting and anodizing treatments; exposure is carried out from a photoreceptor side; the dielectric non-photosensitive layer contains an alkali-soluble resin; and after the development and fixation, the non-image portion is removed by etching.

7. A method according to claim 6, wherein the surface of the printing sheet or the photoreceptor is roughened and an air space of about 1–20 μm is provided between the printing sheet and the photoreceptor, which are placed opposite to each other.

8. A method according to claim 7, wherein the dielectric non-photosensitive layer of the printing sheet contains about 0.1 to about 5% by weight of fine particles having an average particle size of about 1 to about 20 μm.

9. A method according to claim 8, wherein the dielectric non-sensitive layer of the printing sheet has a thickness of 5 μm or less.

* * * * *